United States Patent [19]

Logothetis

[11] 4,338,654

[45] Jul. 6, 1982

[54] VARIABLE SPOT STAGE LIGHT

[76] Inventor: Richard Logothetis, 631 Johnson Ave., Bohemia, N.Y. 11716

[21] Appl. No.: 183,058

[22] Filed: Sep. 20, 1980

[51] Int. Cl.[3] ..... F21V 29/00

[52] U.S. Cl. ..... 362/268; 362/281; 362/285; 362/804

[58] Field of Search ..... 362/268, 281, 285, 307, 362/804

[56] References Cited

U.S. PATENT DOCUMENTS 2,236,845 4/1941 Curry ..... 362/285

4,232,359 11/1980 Leon ..... 362/285

*Primary Examiner*—Donald P. Walsh

*Attorney, Agent, or Firm*—Kevin Redmond

[57] ABSTRACT

A stage light comprising a reflector, an incandescent source, a variable iris and an objective lens system, the position of the lamp and the iris opening being variable individually or in ganged fashion.

2 Claims, 5 Drawing Figures

VARIABLE SPOT STAGE LIGHT

BACKGROUND

1. Field

This invention relates to stage lighting systems and, more particularly, to the means for focusing such systems.

2. Prior Art

The prior art system of FIG. 1 comprises a light source formed of two carbon arc elements 101 and 102, a condenser lens system formed of lenses 106 and 107, adjustable iris 105 and objective lens 108.

In the operation of this system, the light passes from the source through the condenser lenses, the iris, and finally the objective lens as shown by light rays 109 and 110. The lenses 106 and 107 are fixedly connected by link 103 and moved together, closer to farther away from the light source and the iris opening is moved in or out with the movement of the condenser lens by means of the linkage 104, however, the location of the iris remains fixed with respect to the light source.

The condenser lenses in this system unfortunately dissipated approximately 40 percent of the light and the arc lamp requires an appreciable area making this equipment inefficient and large.

The components in the system shown in FIG. 2 are similar to those in FIG. 1 and each component that is similar has the same last digit in both figures. The difference between the system of FIG. 2 and that of FIG. 1 is that in FIG. 2, the iris and the objective lens move rather than the condenser lens. This system also uses condenser lens and an arc lamp source and is therefore similarly large and inefficient.

The system in FIG. 3 eliminates the condenser lenses and substitutes a reflector 311. Two lenses 308 and 310 in the objective lens system are moved for focusing. This system is known as the variable focal length system. The objective lens in this system is typically 11 inches in diameter and weighs four pounds. Although the efficiency is higher than the systems shown in FIGS. 1 and 2 because of the use of the reflector in place of the condenser lens, this lamp suffers from imbalance because of the movement of the large and heavy objective lens system, and from large size because of the use of an arc lamp source.

SUMMARY

It is an object of the present invention to overcome the disadvantages of prior art systems, namely the large size, inefficient use of light, and imbalancing. This is accomplished by eliminating the condenser lens and arc lamp and replacing them with a high powered incandescent or gas lamp and a reflector. In addition, in the present invention, a light weight lamp and an opening in a fixed iris are moved for focusing, eliminating the imbalancing problems of prior art devices.

DETAILED DESCRIPTION OF THE INVENTION

Figure 1:
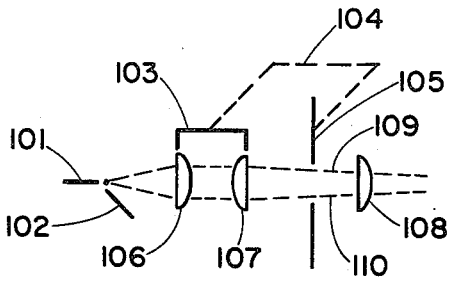
PRIOR ART Fig. 1
FIG. 1 is a first schematic diagram of a prior art stage light system.
Figure 2:
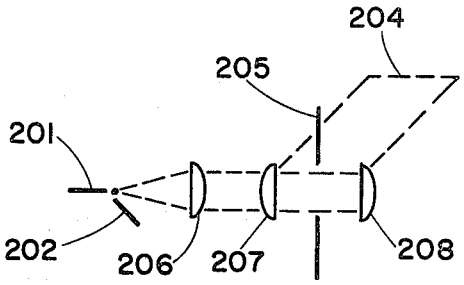
PRIOR ART Fig. 2
FIG. 2 is a second schematic diagram of a prior art stage light system.
Figure 3:
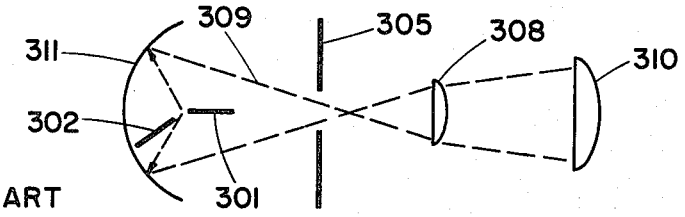
PRIOR ART Fig. 3
FIG. 3 is a third schematic diagram of a prior art stage light system.
Figure 4:
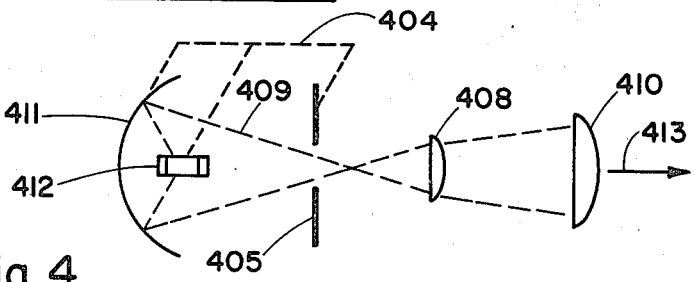
FIG. 4 is a schematic diagram of the present invention.

Referring to FIG. 4, the present invention comprises an incandescent or gas light source 412, a reflector 411, a fixed position, variable aperture iris 405, a fixed position objective lens system formed of lenses 408 and 410. The movement of the light source is ganged to the movement of the gate opening by a linkage 404. This linkage may be disengaged by the operator to provide for individual movement of either the light source or the gate. The arrow 413 indicates a forward direction in which the light beam is directed. During normal operation the linkage is engaged and the operator need merely adjust the linkage control to obtain the spot or lighting size desired. The linkage need not be special as any one of various types, well known in those in the art, may be used.

Figure 5:
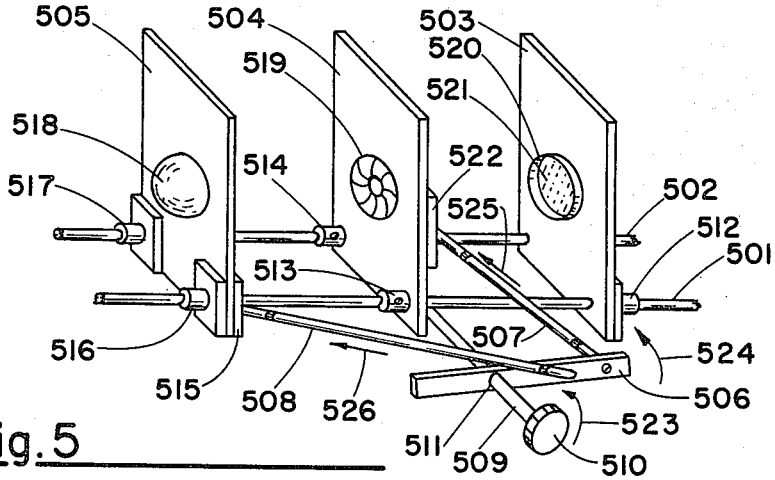
FIG. 5 is a specific embodiment of the invention shown in FIG. 4.

FIG. 5 is a perspective view of an embodiment of the present invention comprising a first guide rod 501, a second guide rod 502, a lens casting 503, an iris casting 504, a lamp casting 506, a master control arm 506, and iris control rod 507, a lamp control rod 508, a master control rod 509, a control knob 510, a master control rod collar 511, a lens guide rod bearing 512, a first iris guide rod clamp 513, a second iris guide rod clamp 514, a lamp control rod ball joint 515, a slide bearing for the light casting on the first guide rod 516, a slide bearing for the light casting on the second guide rod 517, a lamp and a generally parabolic or eliptical reflector assembly unit 518, an iris 519, a lens collar 520, a lens 521, an iris drive mechanism 522, a control knob directional arrow 523, a control arm directional arrow 524, an iris control rod directional arrow 525, a lamp control rod 526 directional arrow.

The guide rods 501 and 502 are connected to the main frame (not shown) and form the principal support for virtually all the elements shown in FIG. 5. The lens and light castings 503 and 505 are slideably mounted on the guide rods by bearings 512, 516 and 517. Casting 503 also has a second slide bearing (not shown) which supports this casting on the second guide rod 502. The iris casting 504 is held in a stationary position relative to the guide rods by clamps 513 and 514. The control knob is fixed to one end of the master control rod 509, while the opposite end of this rod is rotatably supported in a journal box (not shown) mounted to the fixed positioned iris casting 514. One end of the master control arm 506 is fixedly connected to the master control arm by the collar 511. The iris control rod 507 is rotatably connected at one end to the master control arm and at the other end to the iris drive mechanism 522. The light control arm is rotatably connected at one end to the master control arm and at the other to the lamp casting via the lamp control rod ball joint 515. The lamp and eliptical reflector assembly 518 is centrally located in the lamp casting and is positioned to direct light at the central area of the iris casting which contains the iris 519. The lens 521 is centrally positioned in the lens casting to receive and focus the light passing through the iris. The lens is held in this position by the lens collar 520 which is connected to the lens casting 503.

In the operation of this device, the knob 510 is rotated in the direction shown by arrow 523 causing master control rod 509 and master control arm 506 to rotate in the direction shown by arrow 524. This movement of the arm is transmitted through iris control rod 507 and lamp control rod 508 in the direction shown by arrows 525 and 526, respectively. This generally upward movement of iris control rod 507 opens the iris and the accompanying generally lateral movement of lamp control rod 508 moves the lamp and reflector away from the iris.

It should be noted that the mounting of the lamp and reflector on one casting in effect gangs these two elements and causes them to move together, which is significantly different from prior art designs. The linking of both control rods 507 and 508 to the same control arm 506 gangs the movement of the lamp and reflector with that of the iris opening, which is also significantly unlike prior art designs.

The arrangement of the present invention provides several advantages over the prior art. There is greater light efficiency because the condenser lens has been eliminated. Light loss in the iris is minimized because the iris is adjusted to pass maximum light for each position setting of the lamp assembly. The unit is small because the gas or incandescent lamp is smaller than the arc lamp and the new linkage can be made small and therefore does not add appreciably to the size.

I claim:

1. A stage light comprising:

(a) a frame, having a forward direction towards which the light is to be beamed, and a reward direction opposite the forward direction, (b) an incandescent lamp movably mounted within the frame and located towards the rear of the frame, (c) a reflector placed adjacent and to the rear of the lamp and on the same movable mounting as the lamp having general hemispherical coverage of the lamp generally parabolic contours to capture and beam the light from the rear of the lamp in the forward direction, (d) a variable aperture iris fixedly mounted to the frame and positioned forward of the lamp to control the amout of light from the lamp and reflector passed in the forward direction by means of varying the aperture size, (e) an objective lens system located forward of the iris to accept and focus the light passed through the iris, and (f) means for linking the lamp and reflector on the movable mounting to the iris to automatically adjust the iris aperture with the movement of the lamp and reflector for maximum forward light transmission with each setting of the lamp and reflector position.

2. A light as claimed in claim 1 further comprising means for disconnecting the means for linking the lamp and reflector to the iris to provide for varying the iris aperture independent of the lamp and reflector.

* * * * *

REEXAMINATION CERTIFICATE (179th)

United States Patent [19] [11] B1 4,338,654

Logothetis [45] Certificate Issued Mar. 20, 1984

[54] VARIABLE SPOT STAGE LIGHT

[76] Inventor: Richard Logothetis, 631 Johnson Ave., Bohemia, N.Y. 11716

Reexamination Request:
No. 90/000,355, Apr. 4, 1983

Reexamination Certificate for:

| | |
|---|---|
| Patent No.: | **4,338,654** |
| Issued: | **Jul. 6, 1982** |
| Appl. No.: | **183,058** |
| Filed: | **Sep. 20, 1980** |

[51] Int. Cl.[3] ..... F21V 29/00

[52] U.S. Cl. ..... 362/268; 362/281; 362/285; 362/804

[58] Field of Search ..... 362/287, 288, 289, 285

[56] References Cited

U.S. PATENT DOCUMENTS

| | | | |
|---|---|---|---|
| 1,399,111 | 12/1921 | Granz | 362/289 |
| 1,631,529 | 6/1927 | Hill | 362/289 |
| 1,691,475 | 11/1928 | Hall | 362/262 |
| 1,767,756 | 6/1930 | Hall | 362/283 |

*Primary Examiner*—Donald P. Walsh

[57] ABSTRACT

A stage light comprising a reflector, an incandescent source, a variable iris and an objective lens system, the position of the lamp and the iris opening being variable individually or in ganged fashion.

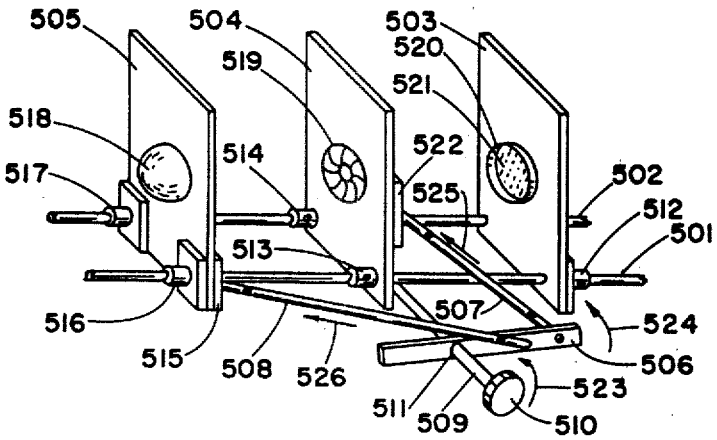

REEXAMINATION CERTIFICATE ISSUED UNDER 35 U.S.C. 307.

NO AMENDMENTS HAVE BEEN MADE TO THE PATENT.

AS A RESULT OF REEXAMINATION, IT HAS BEEN DETERMINED THAT:

Claims 1 and 2, having been finally determined to be unpatentable, are cancelled.

* * * * *